United States Patent [19]

Kane

[11] Patent Number: 4,635,935

[45] Date of Patent: Jan. 13, 1987

[54] AUDIBLE-PHYSICAL COORDINATION RACKET

[76] Inventor: Jerome Kane, 1817 S. Ocean Dr., Hallandale, Fla. 33009

[21] Appl. No.: 685,470

[22] Filed: Dec. 24, 1984

[51] Int. Cl.[4] ..... A63B 69/40

[52] U.S. Cl. ..... 273/30; 273/29 A; 273/76

[58] Field of Search ..... 273/29 A, 186 A, 30, 273/76

[56] References Cited

U.S. PATENT DOCUMENTS

| | | | |
|---|---|---|---|
| 1,519,052 | 12/1924 | Reach | 273/186 A |
| 2,011,185 | 8/1935 | Perryman et al. | 273/76 |
| 3,730,530 | 5/1973 | Oka et al. | 273/186 A |
| 4,094,504 | 6/1978 | Barasch | 273/29 A |
| 4,283,057 | 8/1981 | Ragan | 273/186 A |

*Primary Examiner*—Richard C. Pinkham
*Assistant Examiner*—T. Brown

[57] ABSTRACT

A table tennis racket having one or more whistles positioned thereon for creating a sound in response to the speed of the swing of the racket. The whistles are adjustably attached to the racket head for producing a tone varying according to the angle of the head relative to the given travel direction, whereby a person can practice to control speed and spin consistency of swing. The whistles are generally positioned on the periphery of the playing surface of the racket, although extensions can be provided to hold the whistles. A person uses the racket by swinging it during a practice game and listening for a consistent tone to assure a consistent speed.

3 Claims, 8 Drawing Figures

AUDIBLE-PHYSICAL COORDINATION RACKET

This invention relates to a practice racket of the type used in a racket game and more particularly to such a practice racket having audible tone producing means for producing a tone responsive to the velocity of the swing of the racket.

Many games are played with a ball and a racket. For example, table tennis, racket ball, tennis and many others utilize a racket or paddle like structure to hit a ball within prescribed boundaries in an attempt to score points generally by forcing your opponent to either miss the ball or to hit the ball improperly. Generally speaking, the faster the ball travels, the harder it is for the opponent to either hit the ball or to hit it properly on a return. Since the ball is the same for everyone, the manner in which increased velocity is imparted to the ball is by swinging the racket at maximum acceleration at the point it strikes the ball.

Many types of practice rackets have existed in the prior art for improving the swing of the racket. Generally these practice rackets are designed for allowing the user to practice more accurately hitting the ball as opposed to hitting the ball harder. For example, in U.S. Pat. No. 4,079,935 to Gormley, a tennis racket is provided with a sound indicator in the middle of the racket. Each time the Gormley racket strikes the ball at its center, the sound occurs indicating to the player that he has hit the ball at the proper position on the racket. Another type of practice racket is shown in U.S. Pat. No. 4,239,215 and a practice baseball bat of a similar function is shown is U.S. Pat. No. 3,268,226. None of these practice rackets are used to indicate to the user how fast the racket is being swung. While it is important that the user hits the ball at or near the center of the racket so as to best control the ball, the speed at which the racket strikes the ball is also important. The racket forward speed is directly proportional to the speed at which the ball travels back towards the opponent and generally speaking the ball which travels the fastest will be the most difficult for the which travels the fastest will be the most difficult for the opponent to return.

Not only is racket speed important, but consistency at a high rate of speed is important. As velocity increases the style of swing must adjust to the increased speed. The style will also vary depending on the type of racket used. For example in table tennis—sand, rubber or sponge and the various types of each require different styles, especially where spin is imparted. Depending on the return that they face most experienced players know the maximum controllable speed at which the racket should travel. In order to consistently make good shots the speed at which a player swings a racket generally is considerably less than the maximum speed at which the player could strike the ball. But this is not always the case. In the modern game of table tennis, especially with the inverted sponge racket, it is possible to control on many returns, a smash with the maximum velocity that an experienced player can muster. This is far beyond the average players speed. It would be desirable to have a racket which can be used to build both power and speed through practice before, for example, a mirror even better and in less time than it could be improved in actual play. All that is needed then in actual play is to increase the overspin, and close the racket face on the follow through to compensate for increased velocity.

In playing any racket game, not only is the speed of the racket important, but also the angle at which the racket strikes the ball is important. For example, where a player desires to impart spin to a ball one way or another, the racket is tilted at an appropriate angle and the path of the racket travel changes prior to striking the ball. Again consistency is important here because the player must be used to striking the ball accurately at the appropriate angle and racket travel path. However even at that proper angle and path, the speed of the racket still is important to impart the desired spin and velocity to the ball.

Nothing exists in the prior art which is specifically designed to allow a player of a racket game to practice speed consistency of the racket swing. In providing such a practice racket, one could use the audio-muscular coordination senses to allow the player to hear the speed. As long as the sound is consistent, the speed is consistent. Though the ability to hit the ball consistently is important, in actual play it is essential to vary and change spin, direction, speed, etc. In the game of table tennis, these deliberate variations may force an opponent to err perhaps, and prevent him from adjusting to one type of play. The practice racket could also be useful in developing these deliberate changes in speed and spin.

In accordance with one aspect of this invention there is provided a practice racket of the type a player swings in a racket game comprising a handle for grasping the racket and a head attached to the racket adapted to striking an object of the type used in the game. In addition, the practice racket includes audible tone producing means affixed to the head for producing a tone in response to the velocity at which the racket is moved, whereby a person using the racket can practice to control speed consistency of a swing.

The invention is hereafter described with specific reference being made to the following figures, in which.

Figure 1:
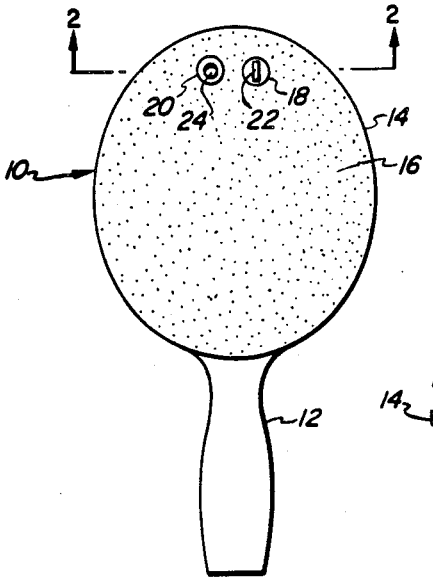
FIG. 1 shows a table tennis racket of the type envisioned by the subject invention.

Referring now to FIG. 1, a table tennis racket 10 is shown. Racket 10 includes a handle 12 and a head 14. Head 14 has thereon a playing surface which may conventionally be of rubber, cork or sponge materials. Playing surface 16 may have a series of pimples extending up from head 14 on the playing surface in a known manner. Positioned at the top edge of playing racket 10 is a pair of whistles, forehand whistle 18 and back-hand whistle 20. Each of the whistles 18 and 20 has a reed 22 shown in the forehand whistle shown in FIG. 1 and a chamber 24 shown in backhand whistle 20. As air flows through one of the whistles 18 or 20 the reed vibrates causing a resonate tone within the chamber 24. This tone can be heard by people in the immediate vicinity of the whistles. The frequency of the tone depends upon the speed of the air through the whistle.

Whistles 18 and 20 are positioned on the end of head 14 most remote from handle 12. While this positioning is not critical, the whistles 18 and 20 should be positioned as far away from the center of the playing surface of racket 10 as possible. With whistles 18 and 20 positioned as shown in FIG. 1, racket 10 can be used to play a game and provide the audible feedback to the player indicating his swing speed. Apparatus could also be provided to block the air flow through whistles 18 and 20. With such apparatus, the racket could be used as an ordinary one at any time.

Whistles 18 and 20 are positioned in opposite directions because the two most common strokes in a racket game are the forehand and the backhand. In each of these strokes, opposite sides of racket 10 strike a ball, hence the air flows through the whistles in opposite directions depending upon the stroke used. For this reason, the two opposite directed whistles 18 and 20 are utilized. In some styles of play, only one side of the racket is used both for the forehand and backhand. For example, in the penholder grip, only the forehand side of the racket is used. With the rubber racket, some players often smash on forehand side using backhand side of racket. In either case practice racket 10 would still provide a sound related to racket speed.

Figure 2:
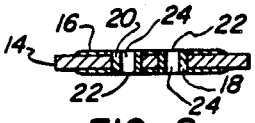
FIG. 2 is a cross section view taken across lines 2—2 of FIG. 1.

Referring to FIG. 2 a cross sectional view taken across lines 2—2 of FIG. 1 is shown. In this view the head 14 is shown covered with the playing surface 16. The two whistles 18 and 20 are shown having reeds 22 on opposite sides of head 14 and chambers 24 beneath the reeds 22. As the air flows through the chamber 24 and vibrates the reed, a resonant sound is created within the chamber 24 causing an audible tone to be heard. The faster that the air travels through chamber 24 the higher pitched the tone becomes and the shorter the duration of the tone becomes. Thus, a player using racket 10 can tell by the tone how fast his racket is traveling. A higher pitched tone indicates a faster swing. Whistles 18 and 20 may be designed so that the tone is only produced above a certain velocity or between certain velocities.

A player may utilize racket 10 for practice in one of two ways. He may play an actual game with the racket or hit back balls served to him from a serving machine. By properly listening to the tone created by whistles 18 or 20 he can control the speed of his forehand and backhand. A player can seek consistency of swing first by trying to obtain consistent pitch tones. Thereafter, he can practice increasing the racket speed by listening to the higher pitches. At the same time, the player should maintain the audible pitches as consistent as possible.

Alternately, a player may merely swing racket 10, for instance, with approximate correct style while looking in a mirror or merely by standing in place. He can do this while at the same time listening to the tone to practice only the speed consistency without worrying about hitting a flying object. By continually swinging the racket, he can judge the consistency of the swing by listening to the consistency of the tone. This is a good technique to utilize when a player is trying to increase the speed. In actual play one can adjust his swing to compensate for increased velocity. In addition, a player can also use the time between tones to determine how fast he can reset and reswing or change from one stroke to another. This becomes important when playing a game against an opponent who stands relatively close to the table and blocks or counterdrives.

Figure 3:
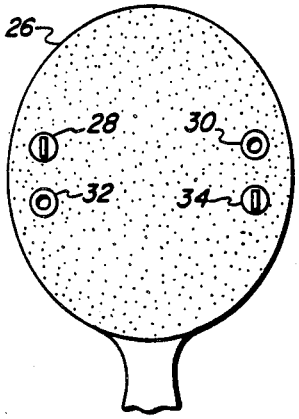
FIG. 3 is an alternate embodiment of the table tennis racket shown in FIG. 1.

Referring now to FIG. 3 an alternate embodiment of a table tennis racket 26 is shown. In racket 26 four whistles 28, 30, 32 and 34 are shown. In this instance whistles 28 and 30 are designed to provide an audible indication during a fast stroke such as a forehand or backhand slam. On the other hand, whistles 32 and 34 are designed to provide an audible tone at a much slower speed such as when racket 26 is used in a forehand or backhand chop stroke. Whistle 28 is designated as a forehand slam whistle and whistle 30 is designated as backhand slam whistle. Similarly, whistle 32 is designated as a backhand chop whistle and whistle 34 as a forehand chop whistle.

As seen in FIG. 3 whistles 28 and 32 are positioned on the periphery of one side of racket 26 and whistles 30 and 34 are positioned on the opposite side of racket 26. All of the whistles 28, 30, 32 and 34 should be fairly close to a line horizontally through the center of the head of racket 26. By positioning the whistles 28, 30, 32 and 34 as shown in FIG. 3 the balance of racket 26 remains essentially unaffected. By appropriately selecting materials of whistles 28, 30, 32 and 34 or any of the other whistles shown in the invention, the density of the remaining portion of the racket 26 can be maintained.

The manner in which racket 26 is used is similar to the manner described with racket 10. However by providing the four whistles 28, 30, 32 and 34 rather than merely the two as provided with respect to racket 10, additional audible muscular coordination sensing can be obtained by the user. For example, the user can practice the smash and the chop strokes in both the forehand and backhand, but he can also listen for the time to go from one stroke to another stroke by mentally measuring the time between sounds. By positioning the whistles as shown in FIG. 3, the racket 26 can still be used to play an actual practice game as well as to practice in front of a mirror or just standing.

Figure 4:
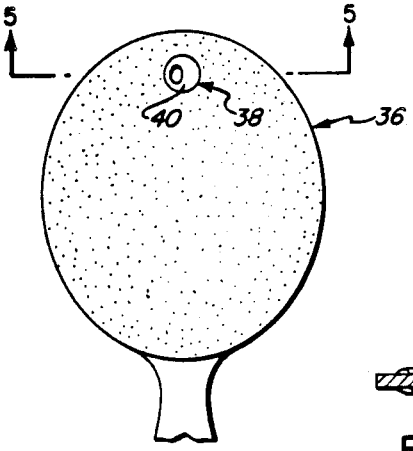
FIG. 4 shows a table tennis racket having an adjustable audible tone producing means affixed therein.
Figure 5:
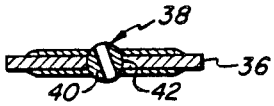
FIG. 5 is a cross sectional view taken across lines 5—5 of FIG. 4.

Referring now to FIGS. 4 and 5 another version of racket 36 is shown having a movable whistle 38. Whistle 38 is positioned in a sperical member 40 which fits into a cavity 42 within racket 36. Whistle 38 is movable within cavity 42 so that the reed and chamber assembly of whistle 38 can be positioned at any desirable angle. By using a spherical member 40 within a spherical shaped cavity 42, a rotation either side to side or front to back can be obtained. This type of whistle is useful for a person who desires to practice a racket stroke which imparts spin to a ball. In this type of a stroke the racket is slanted a certain amount with respect to the perpendicular of the direction of travel towards the ball. In using any of the whistles shown in FIGS. 1 or 3, such a slanting could adversely affect the tone since the full velocity of the air would be misdirected through the chambers. By properly turning whistle 38, the air can be forced directly through the whistle chamber and reed structure to cause the tone to properly occur and obtain an accurate measurement of the speed of the racket.

The manner in which racket 36 shown in FIG. 4 is used is that first the position of whistle 38 is adjusted and thereafter a consistent swing using the proper angular adjustment can be made. As long as the angle remains constant and the speed remains constant, the tone from whistle 38 will remain constant. Thus, the player is allowed to practice not only the racket speed, but by properly adjusting whistle 38, the racket angle when desiring to impart spin. When a different type of spin is desired to be imparted, the angle of whistle 38 can be adjusted and that type of swing can be practiced.

Figure 6:
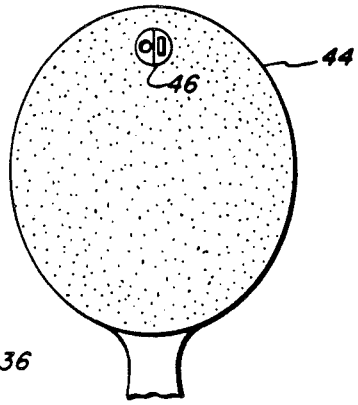
FIG. 6 is another version of the audible tone producing table tennis racket.

Referring now to FIG. 6, racket 44 is shown having a dual chamber whistle 46. Whistle 46 is similar to the prior whistles described but is constructed in a single unitary structure to contain both a forehand and a backhand whistle. Thus, for example, if in FIG. 3 it were desired to reduce the number of whistles, two dual chamber whistles 46 could replace either of the pair of whistles 28 and 32 or 30 and 34. The same is true of the two whistles shown in FIG. 1. Also, the moveable whistle 38 could be designed with dual chambers to allow practice of both forehand and backhand spin imparting swings.

Figure 7:
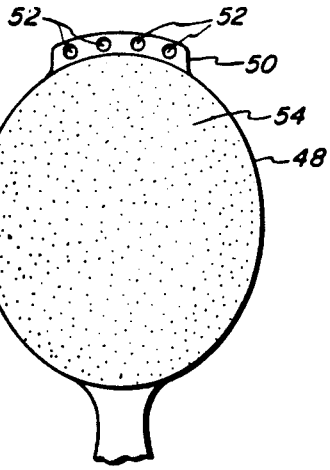
FIG. 7 illustrates yet another version of the audible tone producing table tennis racket.

Referring now to FIG. 7, an alternate placement of the whistles is shown in racket 48. Extension 50 is provided at the outer end of racket 48 upon which any number, for instance four whistles 52 may be placed. The whistles 52 may be any of the previously described types. Connected in this manner the full playing surface 54 of racket 48 is available for the player to use. This type of structure would be particularly useful for a player who desires to utilize the audible tone racket in actually playing a game. However care should be utilized with such a structure. First, extension 50 may first make the racket feel unbalanced and second extension 50 may present a dangerous situation to a player who with a rubber racket after a forehand slam tends to move the racket towards his head in a saluting motion as part of the follow through. Such a player would have to be careful that extension 50 did not hit his head.

Figure 8:
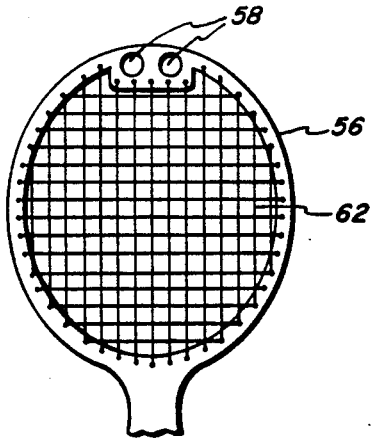
FIG. 8 shows a string racket capable of producing an audible tone in accordance with the invention.

Referring now to FIG. 8 a tennis racket 56 is shown having whistles 58 on an inward extension 60. The strings 62 of tennis racket 56 may be strung from inward extension 60 to create the racket. Thus, the tennis racket may also be used in the same manner as the table tennis racket as described above in FIGS. 1, 3, 4, 6 and 7. The whistles shown in the above examples may also be utilized in other types of rackets such as hand ball rackets or paddle ball rackets if desired. In addition, other whistle placements can be used such as placing the whistle in the center of the racket. Also, other whistle constructions could be used.

What is claimed is:

1. A practice racket of the type a player swings in a table tennis game comprising:

a handle for grasping said racket;

a head integral with said handle adapted for striking an object of the type used in said game; and audible tone producing means affixed to said head for producing a tone varying in response to the velocity at which said racket is moved during practice, said audible tone producing means being a whistle fabricated in a spherical shaped casing, said casing being affixed to said head in an opening which conforms to the shape of the surface of said casing, whereby said tone producing means can be angularly adjusted and a person using said racket can practice various strokes to control speed and spin consistency of swing.

2. The invention according to claim 1, including two other whistles fabricated in spherical casings and affixed to said head in openings which conform to the shape of the surface of said casing.

3. The invention according to claim 1, including at least one other whistle fabricated in a spherical casing and affixed to said head within an opening which conforms to the shape of the surface of said casing.

* * * * *